US005092400A

United States Patent [19]

Jagert

[11] Patent Number: 5,092,400

[45] Date of Patent: Mar. 3, 1992

[54] COILED TUBING HANGER

[76] Inventor: Fritz Jagert, 4315 - 64th Avenue S.E., Calgary, Alberta, Canada

[21] Appl. No.: 649,545

[22] Filed: Feb. 1, 1991

Related U.S. Application Data

[63] Continuation of Ser. No. 387,620, Jul. 31, 1989.

[51] Int. Cl.[5] ..... E21B 33/04

[52] U.S. Cl. ..... 166/88; 166/212

[58] Field of Search ..... 166/382, 385, 77, 86, 166/88, 96, 208, 212, 216, 217

[56] References Cited

U.S. PATENT DOCUMENTS

| | | | |
|---|---|---|---|
| 2,712,455 | 7/1955 | Neilon | 166/88 X |
| 3,438,654 | 4/1969 | Jackson, Jr. et al. | 166/88 X |
| 3,478,822 | 11/1969 | Holbert, Jr. et la. | 166/88 |
| 4,071,085 | 1/1978 | Grable et al. | 166/88 X |
| 4,307,783 | 12/1981 | Lanmon, II | 166/385 X |
| 4,532,987 | 8/1985 | Reed | 166/88 X |
| 4,646,827 | 3/1987 | Cobb | 166/88 |
| 4,836,289 | 6/1989 | Young | 166/385 X |

*Primary Examiner*—William P. Neuder
*Attorney, Agent, or Firm*—Bauer & Schaffer

[57] ABSTRACT

The invention relates to a coiled, endless, tubing hanger, for positive control of well bore pressure. A hanger tool is provided for use with coiled tubing strings when the strings are being installed in new or existing cased well bores. Means are provided hydraulically to seal off well bore pressure between the outside diameter of the coiled tubing string and the annuulus of the hanger tool during installation or removal of the coiled tubing strings. Means are also provided to retain and suspend coiled tubing strings in cased well bores over extended periods of time, or, indefinitely. Mechanical means are provided to seal off well bore pressure between the outside surface of the coiled tubing string and the annulus of the hanger tool during extended or permanent installations of coiled tubing strings in case well bores through transfer of the coiled tubing string plate means by which both the hydraulic and mechanical seals use the same sealing pack-off elements.

5 Claims, 3 Drawing Sheets

COILED TUBING HANGER

RELATED APPLICATION

The present application is a continuation of copending application Ser. No. 387,620, filed July 31, 1989.

Other endless (coiled) tubing hangers do not positively control the well bore pressure while injecting the tubing, which is extremely hazardous to the workers present and the surrounding environment. Still other current hanger systems atempt to control the well bore pressure but require the final packing, backup ring, slip seat and slips to be assembled in three pieces and passed through blow out preventers before becoming operational. With this type of system the operator runs the risk that all or one of the components passing through the bop will become lodged and impede the operation of the bop.

The present device is capable of 100% control of well bore pressure during tubing installation and in emergency situations is capable of collapsing the tubing, thus severely restricting the flow of gas through the tubing until the well can be brought under control. It also includes a means by which the backup rings, final packing and slip seat remain in their landed position thus eliminating the need to pass these items through the bops. The present device is attached above the wellhead master valve while the valve is in the closed position. Coil tubing with an aluminum or plastic plug blocking the internal passage is then injected into the hanger until it rests on the master valve. The hanger contains an internal dual function pack-off element that initially uses hydraulic fluid and hydraulic pressure to pack off the rubber element around the coiled tubing thus eliminating a passage for the well bore pressure to atmosphere. The master valve can now be safely opened or additional pressure holding devices can be mounted atop the hanger. Once the master valve is opened the coil tubing can be injected in to the well until the desired depth is achieved. A set of slips is then attached to the coil tubing and lowered into the hanger slip seat. At this point the hydraulic pressure is released from the hanger pack off element and the weight of the tubing acting through the slips re-energizes the pack-off element mechanically again sealing around the coil tubing and preventing well bore pressure from passing the pack-off point.

To remove the tubing from the well, hydraulic fluid is used to re-energize the pack-off element allowing the slips and meachanical pack-off to be removed. The tubing can now be safely removed from the well bore. The hanger can be reused.

BACKGROUND OF THE INVENTION

This invention relates to new and useful improvements in endless coiled tubing surface hanging devices and the likes to secure the upper end of coil tubing strings and prevent well bore pressure from escaping through the device around the outside of the tubing.

It is often necessary to hang or suspend coiled tubing strings in well casing bores, particularly from the surface.

Landing coiled tubing as a permanent string, as a siphon string, production string, or for use with selective chemical injection well treatments has become popular in many areas.

Current procedures with regard to the use of coiled tubing have encountered numerous problems. First a well must be killed. This is necessary since existing systems and procedures cannot operate when exposed to live well bore pressure.

It is desirable to land the coiled tubing strings in live wells rather than killing the well first with a fluid which will damage the producing zones. In some cases this damage may render the well dead or unusable.

Secondly, the current installation of hanging surface equipment is hazardous to personnel present on the site. Furthermore, existing installation designs require the hanging or coiled tubing at the top of the wellhead. This results in functional loss to all existing wellhead equipment. Valves are not operational.

Still other current systems require that holding and sealing components (packing, slip seat, slips and retainer) be manufactured in halfs so they may be passed through surface blow out prevention equipment. These types of components may become stuck or lodged as they pass through the bop and their split design does not provide a pressure tight system.

The proposed invention eliminates these drawbacks, an operator would have control of the well pressure and well head equipment.

SUMMARY OF THE INVENTION

The present invention overcomes these disadvantages by providing a coiled tubing hanger that has the pressure retaining bop and mechanical pack-off elements integral as one element with in the body of the hanger.

By utilizing the coiled tubing hanger described, the coil tubing can be inserted and withdrawn from the well bore under live well conditions allowing other surface equipment such as, bops, strippers, tubing injectors and lubricator riser sections to be detached or re-attached to the tubing hanger, and well head as well, as required depending on the procedure to be performed while maintaining a safe working environment by controlling well bore pressure.

The principal object and essence of the invention is to provide an improved coiled tubing hanger for use with hollow flexible endless tubing for hanging (supporting) said tubing and sealing around said tubing during inserting and withdrawing procedures of same into and out of casing of a live well bore.

Another object of the invention is to provide a device of the character herewithin described which is particularly suited for use with a source with hydraulic fluid and pressure in as much as it is preferable to attach a hydraulic pump to the tubing hanger thus inflating the pack-off element and causing the element to close around the coiled tubing thereby preventing the passage of well bore pressure between the outside of the coiled tubing and inside of the hanger body.

Yet another object of the invention is to provide a device of the character herewithin described which provides means to apply the weight of the coiled tubing string to the pack-off element thus energizing the pack-off element and causing the element to close around the coiled tubing thereby preventing the passage of well bore pressure through the use of a positive mechanical device.

Still another aspect of the invention is to provide a device of the character herewithin described which is simple in construction, small and light to handle, economical in manufacture, can be re-used and otherwise well suited to the purpose for which it is designed.

With the foregoing objects in view, and such other objects and advantages as will become apparent to those skilled in the art to which this invention relates as this specification proceeds, our inventions consists essentially in the arrangement and construction of parts all as hereinafter more particularly described, reference being had to the accompanying drawings in which:

BRIEF DESCRIPTION OF THE DRAWINGS

In the drawings like characters of reference indicate corresponding parts in the different figures, and in the following description.

DETAILED DESCRIPTION

Figure 1:
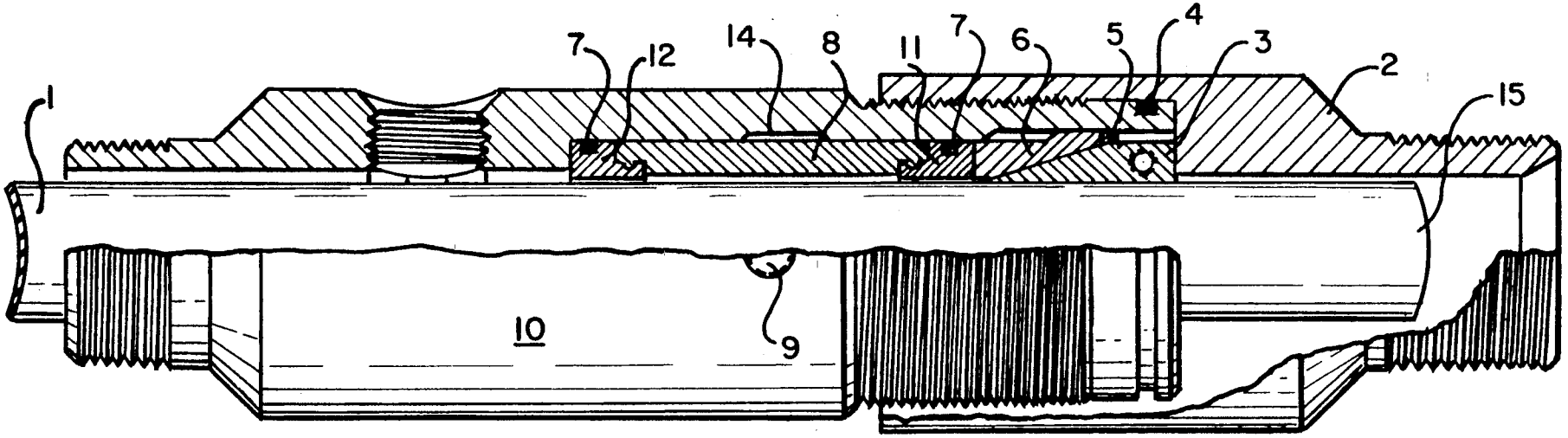
FIG. 1 is a side elevation partly in cross-section through the coiled tubing hanger prior to installation on a well bore casing and showing the internal parts and components. The hanger is shown with threaded connections for low pressure well applications.
Figure 2:
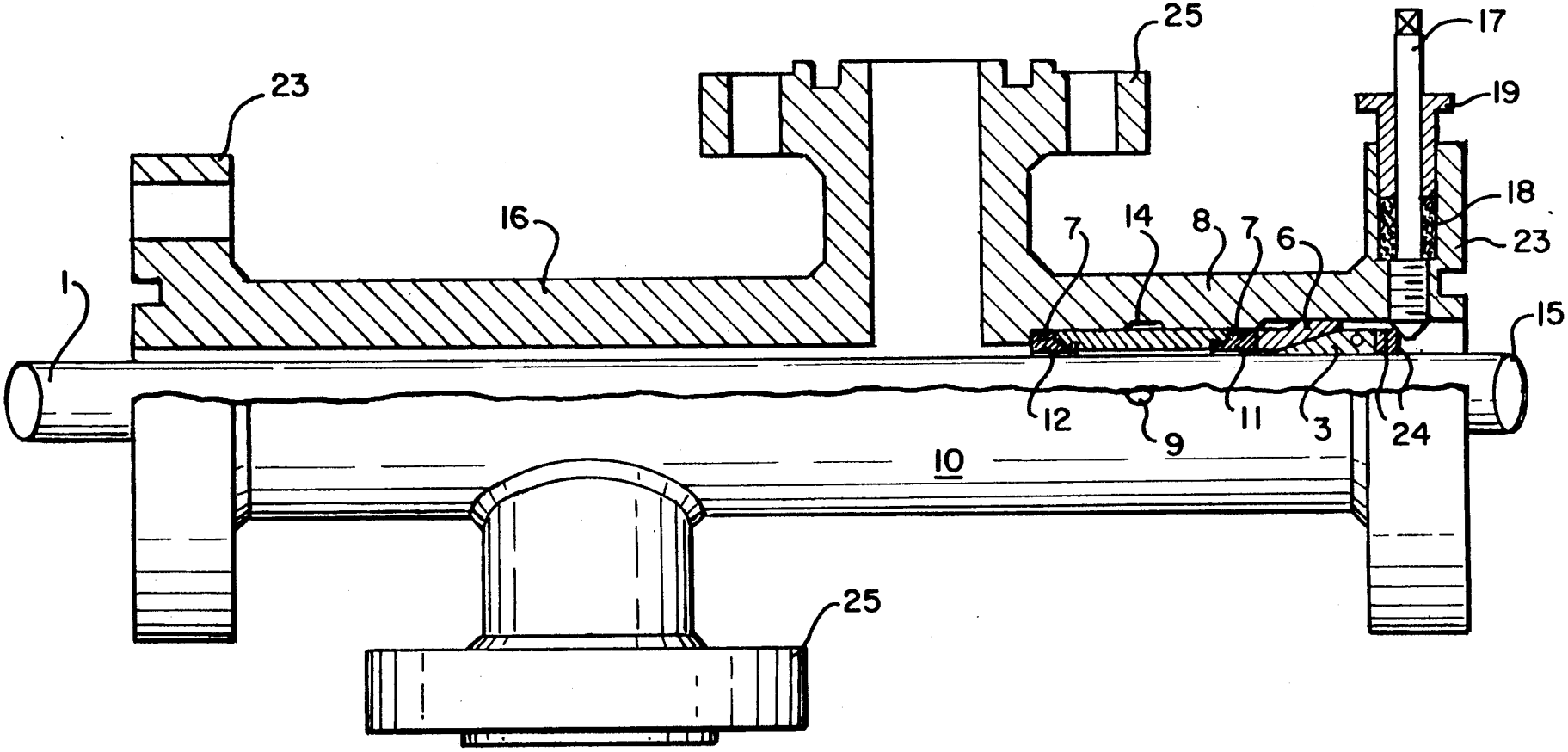
FIG. 2 is a side elevation partly in cross-section through the coil tubing hanger showing with approved flange connections and flanged side ports. Also shown is the flange retaining system.

Proceeding therefore to describe the invention in detail reference should be made to FIG. 1 or 2 which illustrate a typical hanger body 10 with side port or ports and a threaded or flanged bottom connection.

The wellhead is disassembled to the desired installation point of the hanger. Normally this would be directly above the lowest master valve. The master valve has been closed in and pressured bled off.

The hanger body 10 is then attached to the cased well bore above the master valve, less the hanger cup 2 and the slips 3.

A pack-off element consisting of items 11, 12, and 8 is located within the body 10. The pack-off element consists of an upper shoe 11 and a lower shoe 12 each with an o-ring groove 7 cut in the outer diameter to contain the hydraulic fluid supplied by the hydraulic source 9.

The flexible packing element 8 is bonded to the upper shoe 11 and lower shoe 12 by means of a mold injection bonding process. The flexible packing 8 is made from material that will allow it to deform inward and down then return to its original shape. The bond between the flexible element 8 and the packer shoes 11, 12 is capable of withstanding pressure.

Contact between the upper and lower shoe o-rings 7 and the hanger 10 internal wall combined with the bond 13 between the flexible element 8 and the upper 11 and lower 12 shoes forms a pressure retaining pocket 14.

As hydraulic fluid is introduced through the external source 9 into the pressure retaining pocket the flexible element 8 is formed outward sealing around the coiled tubing string 1. The seal that is formed is pressure tight and will not allow pressure from above or below the pack-off element 8, 11, 12 to pass the contact point.

Located above and freely resting on the pack-off element is a single piece tapered wall slip bowl 6. Both the slip bowl 6 and the pack-off element 7, 8, 11, 12 are restrained within the hanger body 10 through the use of a restraining system 5.

The slips 3 are attached to the coiled tubing string 1 at the desired coiled tubing landing point by means of the slip restraining system.

The slips are lowered into the slip seat 6 by means of the coiled tubing string.

As the slips 3 engage the slip seat 6 the entire weight of the coiled tubing string 1 is transferred through the slips and into the slip seat 6 which in turn transfers the string weight onto the pack-off element 7, 8, 11, 12 causing the top shoe 11 to be forced downward causing the flexible element 8 to move in towards the tubing sealing off the annulus area between the coiled tubing and the pack-off element.

The hydraulic fluid in the pressure restraining pocket 14 can now be bled off leaving a fail safe mechanical seal provided by the coiled tubing string weight as explained above.

The coiled tubing string 1 is cut off at 15 in the vicinity just above the hanger body.

The retaining cap 2 is used to lock the slip 3 in place against the well bore pressure from trying to hydraulic or jack the tubing upwards.

Figure 4A:
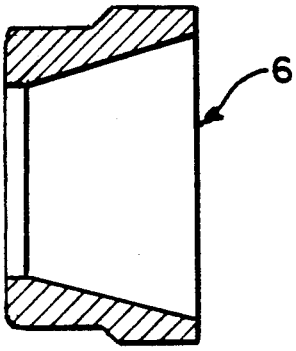
FIGS. 4A and 4B comprise a cross-section and end elevation of the slip seat.
Figure 4B:
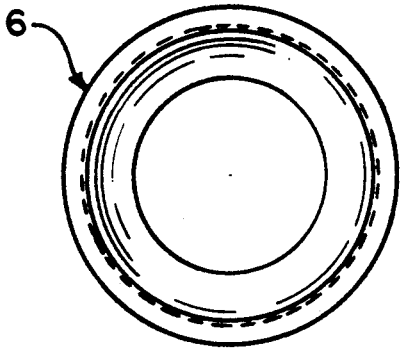

Production well bore pressure produced up the coiled tubing 1 annulus is prevented from leaking from the cap by means of the retaining cap seal 4. FIG. 4 shows a flanged hanger body 16 that has indentical internal components to FIG. 1 but uses a threaded taper nosed bolt 17, packing 18 (see FIG. 2), to seal in pressure 4 and a retaining nut 19 to prevent upward movement of the slips 3 and coiled tubing 1 instead of the retainer cap 2 shown in FIG. 1. The upward movement is caused by well bore pressure acting on the coiled tubing string 1 should the string be fitted with a plug on its lower end.

Figure 3A:
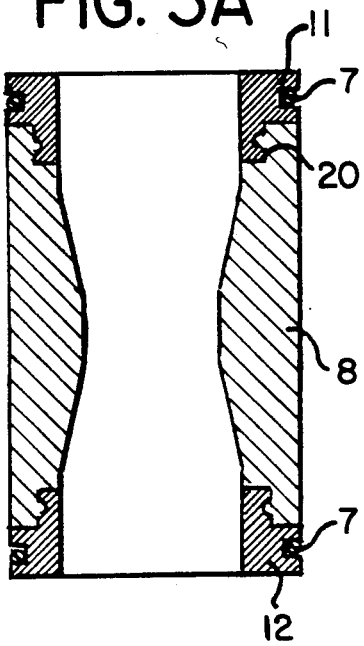
FIGS. 3A and 3A' are cross-section elevations of the pack-off element.
Figure 3A:
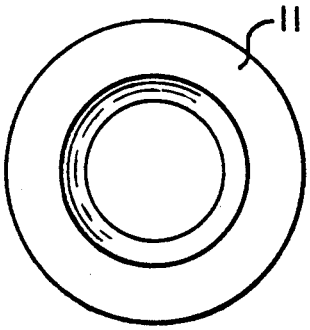
Figure 3B:
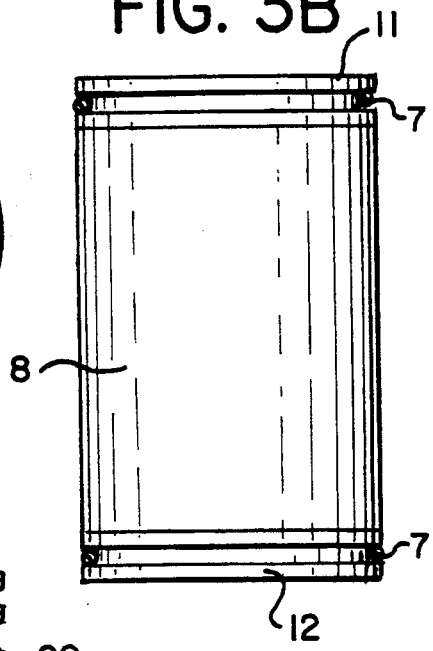
FIG. 3B is a side elevation of the pack-off element.
Figure 3C:
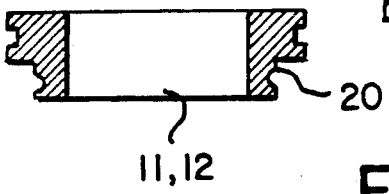
FIG. 3C Is a sectional detail of the pack-off shoe element.

FIGS. 3A, 3B and 3C show the various components of the pack-off element: The upper shoe 11, lower shoe 12, o-ring seals 5 and the flexible element 8. The internal profile of the flexible element 8 can be modified to allow operation with various tools and coiled tubing sizes.

FIG. 3B also shows the profile required for a pressure capable bond between the pack-off shoes 11, 12 and the flexible element 8.

The three bore on the shoes 11 and 12 is sized for clear passage of each size of tubing and therefore varies in size.

FIG. 4 shoes the single piece floating tapered slip seat 6 in section and in plan view, the slip seat is restrained from moving upward but is free to move downward when energizing the pack-off elements 11 and 12.

Figure 5A:
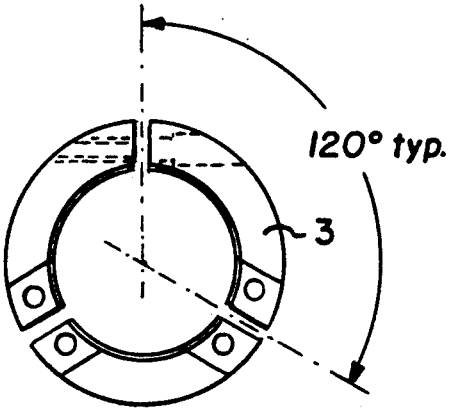
FIGS. 5A and 5A' are top plan and sectional details of the slip assembly.
Figure 5A:
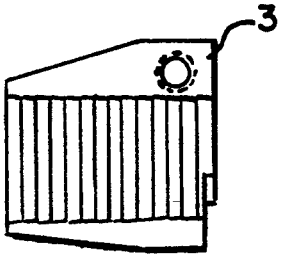
Figure 5B:
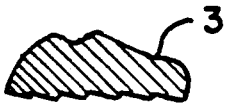
FIG. 5B is a sectional thread detail.

FIG. 5 shows the three piece slip assembly 3 and the slip restraining system 21 used to secure the slips to the coiled tubing string 1. The slip 1.D is cut with a buttress thread profile 22 and surface hardened to increase its holding power.

Since various modifications can be made in our invention as hereinabove described, and many apparently widely different embodiments of the same made within the spirit and scope, it is intended that all matters contained in the accompanying specification shall be interpreted as illustrative only and not in a limiting sense.

What is claimed is:

1. A hanger for installing tubing strings in cased well bores, said hanger comprising a tubular body to be fit over the string and having means for suspending said string in said well bore, pack-off means interposed between said hanger body and string comprising a deformable cylindrical member, seal means located at each end of said cylindrical member to close the space between the outer surface of the cylindrical member and the inner surface of said hanger to well bore pressure and means for selectively deforming the cylindrical member to form an annular seal about the string to occlude well bore pressure therebetween, said means for deforming said cylindrical member comprising means for mechanically compressing said cylindrical member from at least one end thereof.

2. The hanger according to claim 1 wherein said means for deforming said cylindrical member comprises an inlet/outlet in the wall of said hanger body connectable to a source of fluid under pressure to be applied to the outer surface of said cylindrical member in the space between said seals.

3. The hanger according to claim 1 wherein said means for deforming said cylindrical member comprises means for mechanically compressing said cylindrical member from at least one end thereof.

4. The hanger according to claim 1 wherein said means for deforming said cylindrical member comprises a selectively actuatable combination of a source of hydraulic fluid applied against the outer surface of said cylindrical member through the wall of said hanger body and mechanical means for applying axial compression against at least one end of said cylindrical member.

5. The hanger according to claim 3 wherein the means for suspending the string in said well bore includes a set of slips and a slip seat located in said hanger body adjacent one end of said pack-off means, said slip seat floating freely within said hanger body and said slips being attached to said string whereby when said string is lowered into said well bore said slips engage with said slip seat to suspend said string, the weight of said string causing said slip seat to engage to end of said deformable cylindrical member to mechanically form said annular seal.

* * * * *